US006096235A

United States Patent [19]

Asako et al.

[11] Patent Number: 6,096,235

[45] Date of Patent: Aug. 1, 2000

[54] ELECTRORHEOLOGICAL FLUID COMPOSITION COMPRISING AN ELECTRICALLY INSULATING OIL AND DIELECTRIC PARTICLES OF POLYMER GRAFTED CARBON BLACK DISPERSED THEREON

[75] Inventors: Yoshinobu Asako, Tsuchiura; Yoshikuni Mori, Takatsuki; Satoru Ono, Tsuchiura, all of Japan

[73] Assignee: Nippon Shokubai Co., Ltd., Osaka, Japan

[21] Appl. No.: 08/859,211

[22] Filed: May 20, 1997

Related U.S. Application Data

[63] Continuation of application No. 08/356,560, Dec. 15, 1994, abandoned.

[30] Foreign Application Priority Data

Dec. 15, 1993 [JP] Japan ..... 5-315124

[51] Int. Cl.[7] ..... C10M 171/00; C10M 169/04

[52] U.S. Cl. ..... 252/78.3; 252/76; 252/79; 252/572

[58] Field of Search ..... 252/78.3, 73, 572, 252/76, 79

[56] References Cited

U.S. PATENT DOCUMENTS

| | | | |
|---|---|---|---|
| 4,687,589 | 8/1987 | Block et al. | 252/73 |
| 4,994,520 | 2/1991 | Mori et al. | 524/547 |
| 5,252,250 | 10/1993 | Endo et al. | 252/73 |
| 5,376,294 | 12/1994 | Okada et al. | 252/78.3 |
| 5,558,803 | 9/1996 | Okada et al. | 252/78.3 |

FOREIGN PATENT DOCUMENTS

| | | |
|---|---|---|
| 0 272 127 A2 | 6/1988 | European Pat. Off. . |
| 0 361 106 A1 | 4/1990 | European Pat. Off. . |
| 0361106 | 4/1990 | European Pat. Off. . |
| 0 445 594 A1 | 9/1991 | European Pat. Off. . |
| 0 529 166 A1 | 3/1993 | European Pat. Off. . |
| 0529166 | 3/1993 | European Pat. Off. . |
| 0 555 487 A1 | 8/1993 | European Pat. Off. . |
| 0 636 683 A1 | 2/1995 | European Pat. Off. . |
| 42-22047 | 10/1967 | Japan . |
| 62-153295 | 7/1987 | Japan . |
| 64-6093 | 1/1989 | Japan . |
| 1-236291 | 9/1989 | Japan . |
| 3-137196 | 6/1991 | Japan . |
| 4-120196 | 4/1992 | Japan . |
| 5-86075 | 4/1993 | Japan . |

*Primary Examiner*—Christine Skane
*Attorney, Agent, or Firm*—Kubovcik & Kubovcik

[57] ABSTRACT

An electrorheological fluid composition comprises dielectric particles as a disperse-phase and an electrically insulating oil as a dispersion medium, wherein the dielectric particle has a polymer portion and an electrically conductive carbon black portion and the polymer portion is grafted on the carbon black portion. The electrorheological fluid composition shows a large change in viscosity and the small current properties under an applied electric field, and excellent fluidity and dispersion stability in an absence of an applied electric field.

8 Claims, 1 Drawing Sheet

ELECTRORHEOLOGICAL FLUID COMPOSITION COMPRISING AN ELECTRICALLY INSULATING OIL AND DIELECTRIC PARTICLES OF POLYMER GRAFTED CARBON BLACK DISPERSED THEREON

This application is a continuation of application Ser. No. 08/356,560, filed Dec. 15, 1994, now abandoned.

FIELD OF THE INVENTION

The present invention relates to an electrorheological fluid composition whose viscosity greatly varies under an applied electric field.

BACKGROUND OF THE INVENTION

An electrorheological fluid is known as a fluid which is obtained by dispersing disperse-phase particles in an electrically insulating dispersion medium, and which has a rheological characteristic that changes from the Newtonian viscosity to the Bingham viscosity under an externally applied electric field. It is also generally known that an electrorheological fluid composition shows a so-called Winslow's effect that the viscosity thereof greatly increases and a large shear stress is induced under an externally applied electric field.

Since the Winslow's effect has a characteristic that it shows a shear stress which quickly changes in response to an externally applied electric field, the electrorheological fluid can be applied to a variety of driving devices such as a clutch, a brake, an engine mount, a damper, a valve, a shock absorber, an actuator, an inkjet using an electrorheological fluid, etc.

Examples of conventional electrorheological fluids in which a carbon material is used as a disperse-phase include: fluids using insulating (dielectric) carbon materials such as meso-phase carbon (Japanese Unexamined Patent Publication No. 45196/1992 (Tokukaihei 4-45196), carbonaceous powders (Japanese Laid-Open Patent Publication No. 169025/1990 (Tokukaihei 2-169025), Japanese Laid-Open Patent Publication No. 47896/1991 (Tokukaihei 3-47896), Japanese Laid-Open Patent Publication No. 247696/1991 (Tokukaihei 3-247696), Japanese Laid-Open Patent Publication No. 247698/1991 (Tokukaihei 3-247698), Japanese Laid-Open Patent Publication No. 279206/1991 (Tokukaihei 3-279206), Japanese Laid-Open Patent Publication No. 211499/1992 (Tokukaihei 4-211499), and Japanese Laid-Open Patent Publication No. 348192/1992 (Tokukaihei 4-348192); fluids using insulating (dielectric) composite materials in which an electrically conductive carbon material is dispersed in an insulating matrix so as to apply an insulating (dielectric) property such as a composite material in which carbon black is dispersed in a resin (Japanese Laid-Open Patent Publication No. 236291 (Tokukaihei 1-236291). However, the above-listed electrorheological fluids present the problem of poor dispersion stability due to the agglomeration and settlement of the disperse-phase particles in the dispersion medium.

Electrorheological fluids containing dielectric materials obtained by coating the surface of an electrically conductive particle with the electrically insulating thin film have been proposed. These examples include fluids using electrically conductive particles with a surface coated with the electrically insulating thin film (Japanese Laid-Open Patent Publication No. 6093/1989 (Tokukaisho 64-6093), and fluids using carbon particles having a surface thereof coated with the electrically insulating thin film (Japanese Laid-Open Patent Publication No. 169025/1990 (Tokukaihei 2-169025). Regarding the above-mentioned fluids, an application of these particles of several microns or above was examined, and discovered that the electrorheological in which these particles were used as the disperse-phase had poor dispersion stability. Moreover, if the electrically conductive particles or carbon particles are below sub micron, an interaction between the particles is strong. Therefore, when the coating methods such as the micro capsule method or the surface treatment using a silane coupling agent are applied to the less-than sub micron particles, the aggregation between particles cannot be prevented. Therefore, the problem is present in that the desirable dielectric materials for disperse-phase cannot be obtained. Especially when the electrically conductive particles or carbon fine particles are the carbon black of less-than sub micron diameter, an interaction between the carbon black particles is extremely strong, and a desirable dielectric material for the disperse-phase cannot be obtained.

As a method for simultaneously providing an insulating property and dispersion stability to electrically conductive particles, a technique for reacting a reactive silicone oil with a treated particle which is obtained by treating the surface of an inorganic electrically conductive particle with a silane coupling agent has been proposed (Japanese Laid-Open Patent Publication No. 120196/1992 (Tokukaihei 4-120196). According to this disclosure, however, since the processing using the silane coupling agent becomes complicated, the manufacturing cost increases. Moreover, since the coupling reaction is a condensation reaction which produces water, the problem is present that the resulting water lowers the insulating properties of the electrorheological fluid. Moreover, when the electrically conductive particles are carbon black of less than sub-micron diameter, an interaction between carbon black particles is very strong. Therefore, when processing with the silane coupling agent, the aggregation of the particles occurs, and even if the resultant substance is reacted with the reactive silicone, desirable dielectric particles for the electrorheological fluid cannot be achieved.

Examples of electrorheological fluids which show excellent dispersion stability include: fluids using liquid crystal compounds (see Japanese Laid-Open Patent Publication No. 191511/1992 (Tokukaihei 4-191511), Japanese Laid-Open Patent Publication No. 266997/1992 (Tokukaihei 4-266997), Japanese Laid-Open Patent Publication No. 337389/1992 (Tokukaihei 4-337389), Japanese Laid-Open Patent Publication No. 348194 (4-348194)), and a uniform electrorheological fluid such as fluids using dielectric polymer (YURNS research report, 2, 58 (1990), etc.). However, the above listed electrorheological fluids present the problem of high viscosity and poor fluidity in an absence of the electric field. Especially, when the liquid crystal compound is used, a high cost is required.

SUMMARY OF THE INVENTION

An object of the present invention is to provide an electrorheological fluid composition whose viscosity greatly changes, which shows an excellent current property that the current density is small under an applied electric field and excellent dispersion stability and fluidity in an absence of an electric field, the electrorheological fluid composition being manufactured at low price.

Dispersion stability suggests an ability to maintain an electrorheological fluid for a long period of time without having disperse-phase particles settled or floated in the dispersion medium. Fluidity suggests the viscosity of the fluid in the absence of an electric field is low.

The inventors of the present invention examined especially on the disperse-phase particle, and discovered that the electrorheological fluid composition having the dielectric particle in which a polymer portion was grafted on an electrically conductive carbon black portion showed a great change in the viscosity under an applied electric field, and excellent current property and could be manufactured at low price. The described electrorheological fluid composition also showed excellent dispersion stability and fluidity in an absence of an electric field.

The electrorheological fluid composition of the present invention comprises dielectric particles as a disperse-phase and an electrically insulating oil as a dispersion medium, the dielectric particle has a polymer portion and an electrically conductive carbon black portion, and the polymer portion is grafted on the carbon black portion.

As in the dielectric particles, the polymer portion is grafted on the carbon black portion, the polymer portion extends from the surface of the carbon black portion into the electrically insulating oil, and the polymer portion can be placed between plural carbon black portions. As a result, the agglomeration of the dielectric particle in the electrically insulating oil can be prevented, and excellent dispersion stability of the electrorheological fluid composition can be achieved.

Especially, when the polymer portion has an affinity for the electrically insulating oil, since the electrically insulating oil surrounds the circumference of the polymer portion, not only by the polymer portion but also by the electrically insulating oil, the electrically insulating property between the carbon black portions can be effectively maintained.

The dispersion medium in the electrorheological fluid composition of the present invention may be any electrically insulating oil. Examples of such dispersion medium includes: silicone oil such as polydimethylsiloxane, partially octyl substituted polydimethylsiloxane, partially phenyl substituted dimethylsiloxane, fluoro silicone oil, etc.; hydrocarbon such as liquid paraffin, decane, decene, methylnaphthalene, decaline, diphenylmethane, toluene, dimethylbenzene, methylbenzene, diethylbenzene, propylbenzene, cyclohexane, partially hydrogenated triphenyl, etc.; halogenated hydrocarbon such as chlorobenzene, dichlorobenzene, bromobenzene, chlorobiphenyl, chloro diphenylmethane, etc.; fluoride such as Daifloil (available from Daikin Kogyo Co., Ltd.), Demnum (available from Daikin Kogyo Co., Ltd.), ester compound such as ethyl benzoate, octyl benzoate, dioctyl phthalate, trioctyl trimellitate, dibutyl sebacate, etc. One kind or more than one kind of the above listed material may be used. Considering fluidity, the viscosity of the electrically insulating oil is preferably equal to or below 0.05 Pa·s.

It is preferable that an electrically insulating oil is a silicone containing insulating oil because excellent fluidity of the electrorheological fluid composition can be achieved.

Any silicone containing insulating oil having the described silicone oil as a main component, having a substantially electrically insulating property may be used. The silicone oil that is a main component of the silicone insulating oil has a siloxane structure, in general, it is applicable to a damping oil, an air insulating oil, an impregnating injection oil, a lubricating oil, a polishing agent, ingredients in cosmetics, a parting agent, a deaerating agent, etc.

Regarding the dielectric particle as the disperse-phase of the present invention, it is required that the dielectric particle have a polymer portion and an electrically conductive carbon black portion and the polymer portion is grafted on the carbon black portion. The "graft" in the present invention suggests that an irreversible addition reaction of a polymer with substrate such as a carbon black, etc. as defined in "carbon black" by Donnet et al. By performing an irreversible addition reaction, the polymer can be chemically bonded to the surface of the carbon black particle, thereby ensuring the bonding. Addition reactions applicable to the graft reaction include: electrophilic addition reaction, radical addition reaction, nucleophilic addition reaction, addition cyclizing reaction.

The dielectric particle as the disperse-phase of the present invention may be the carbon black graft polymer in which a polymer portion is grafted on an electrically conductive carbon black portion. In the broader meaning, a carbon black graft polymer is a composite in which a polymer is physically or chemically bonded to the surface of the carbon black. The carbon black graft polymer is generally used as coloring agents, an ink, toner for a copying machine, a coating material, a plastic forming material, etc., or a modifier for various polymers, etc. The carbon black graft polymer was disclosed, for example, in Japanese Examined Patent Application No. 22047/1967 (Tokukosho 42-22047), Japanese Examined Patent Application No. 3826/1969 (Tokukosho 44-3826), Japanese Examined Patent Application No. 17248/1970 (Tokukosho 45-17248), Japanese Examined Patent Application No. 26970/1971 (Tokukosho 46-26970), and Japanese Examined Patent Application No. 24868/1990 (Tokukohei 2-24868). However, the dielectric particles of the present invention must be the carbon black graft polymer in which a polymer is chemically bonded on the surface of the carbon black by the addition reaction, because the dielectric particles are required to have excellent electrically insulating property or a mechanical strength. In the case of the carbon black graft polymer in which a polymer is physically bonded on the surface of a carbon black, the carbon black is easily separated from the polymer, thereby presenting the problem that the resulting carbon black graft polymer does not have sufficient electrically insulating property nor a mechanical strength. In the case of the carbon black graft polymer in which a polymer is chemically bonded to the surface of a carbon black by a condensation reaction, due to water and methanol resulting from the condensation reaction, the carbon black graft polymer may not show sufficient electrically insulating property for a disperse-phase.

In the cases that a mixture of an electrically conductive carbon black and a polymer and an electrically conductive carbon black alone is used as a disperse-phase, the following problems may occur: dispersion stability of the prepared electrorheological fluid composition cannot be achieved, or electrically insulating property in the composition cannot be ensured when an electric field is applied until the desirable change in viscosity is achieved.

Regarding the dielectric particles of the present invention, it is preferable that the average particle diameter of the dielectric particle is in a range of 0.001–0.5 $\mu$m. If the average particle diameter is below 0.001 $\mu$m, a great change in the viscosity cannot be achieved even when an electric filed is applied. On the other hand when the average particle diameter is above 0.5 $\mu$m, desirable dispersion stability of the resulting electrorheological fluid composition may not be achieved.

It is preferable that the polymer portion of the dielectric particle in the present invention includes a carbon—carbon bond in the main chain. Various carbon black graft polymer in which a polymer and an electrically conductive carbon black are chemically bonded are known and can be manufactured at low price. The reason why the described carbon black graft polymer can be manufactured at low price is that the used polymer has many carbon atoms and the polymer portion has a large affinity for the used carbon black, and therefore the polymer can be more effectively grafted on the carbon black. In the case of using a polymer composed only of a polysiloxane as a raw material for the polymer portion without a carbon—carbon bond in the main chain, the grafting cannot be performed effectively, and the carbon black graft polymer suitable for the disperse-phase may not be obtained.

It is preferable that the polymer portion includes the main chain obtained from polymerization of vinyl monomers in the polymer portion having a carbon—carbon bond in the main chain. The polymer obtained by polymerizing the vinyl monomers includes the main chain having carbon—carbon bonds, and has a large affinity for the carbon black, thereby achieving an effective grafting. Moreover, many vinyl monomers having a reactive group for use in grafting are known. If the polymer portion does not include a main chain obtained by polymerizing the vinyl monomers, the grafting may not be performed effectively.

It is preferable that the polymer portion has an affinity for the electrically insulating oil. If the polymer portion does not have an affinity for the electrically insulating oil, the electrorheological fluid composition that shows desirable dispersion stability cannot be achieved.

It is also preferable that the polymer portion includes a silicone containing component, more preferably includes a silicone containing component in the side chain. If the polymer portion does not includes silicone containing component, the resulting electrorheological fluid composition may not show desirable dispersion stability. Especially when the silicone containing insulating oil suitable for the dispersion medium is used, if the polymer portion does not include a silicone component, dispersion stability may not be achieved.

Examples of a silicone containing component include: a which includes a polyorganosiloxane group such as a polydimethylsiloxane group, a partially alkyl siloxane group, a substituted polydimethylsiloxane group, a partially aryl substituted polydimethylsiloxane group, or a tris(trialkyl siloxane)silylpropyl group, etc.

It is preferable that the polymer portion includes a silicone containing component having a polysiloxane containing structure unit represented by formula (1):

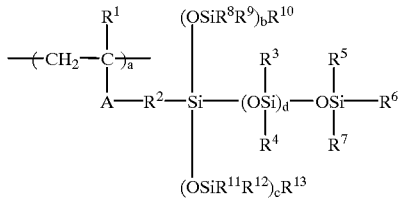

(1)

wherein, A is —COO— or a phenylene group, $R^1$ is hydrogen atom or methyl group, $R^2$ is an alkylene group having from 1 to 6 carbon atoms, $R^3$–$R^{13}$ are independently an aryl group, an alkyl group having from 1 to 6 carbon atoms or an alkoxy group having from 1 to 10 carbon atoms, a is a natural number, b and c are independently 0 or integers selected from 1–10, and d is 0 or an integer selected from 1–200.

It is preferable that the ratio of the electrically conductive carbon black portion to the polymer portion in the dielectric particle is in a range of 100 parts by weight to 10–3000 parts by weight, and more preferably in a range of 100 parts by weight to 50–1000 parts by weight. When the ratio of the polymer portion is less than 10 parts by weight, the current density under an applied electric field may become large. When the ratio of the polymer portion exceeds 3000 parts by weight, even if an electric field is applied to the prepared electrorheological fluid composition, a large change in the viscosity may not be achieved.

The polymer portion and the carbon black portion in the dielectric particle in the present invention are preferably grafted by an addition reaction of an electrically conductive carbon black and a polymer having a reactive group to the carbon black. By the addition reaction of the carbon black and the polymer having a reactive group, the reaction between a functional group on the surface of the carbon black and the reactive group in the polymer can be accelerated so as to form a chemical bond. Therefore, a desirable dielectric particle of the present invention can be achieved. Moreover, when a polymer without having a reactive group is used, the polymer cannot be grafted on the carbon black effectively, and thus the current density under an applied electric field becomes large.

The carbon black used in the present invention must have electrically conductive property. The electrically conductive property in the present invention suggests a property that an electric resistance with respect to the electric conductivity is low. It is generally said that a carbon black is semiconductive. However, the present invention includes not only the semiconductive carbon black but also includes an electrically conductive carbon black.

Whether or not a carbon black shows an electrically conductive property can be easily determined by the following methods. A carbon black or a mixture composed of a carbon black and a polydimethyl siloxane (silicone oil) having a large electrically insulating property prepared in a range of 100 parts by weight to 50–300 parts by weight is placed in a space of 1 mm between electrodes, and an electric field of 3 kV is applied between electrodes. Here, those in which current flows at a current density of above 300 $mA/cm^2$ or those in which dielectric breakdown occurs and to which an electric field of 3 kV cannot be applied is defined as the electrically conductive carbon black. It is preferable that a carbon black applicable the present invention has an electric conductivity to of above $10^{-10}$ $S \cdot cm^{-1}$. The carbon black used in the present invention is not specified, and known carbon blacks may be used such as thermal black, channel black, furnace black, acetylene black, color black, etc. When the carbon black that is not electrically conductive is used, the problem is presented in that a large viscosity change cannot be achieved under an applied electric field.

Among the above-listed carbon blacks, those having a functional group such as a carboxyl group, hydroxyl group, etc., on the surface thereof, and those having a carboxyl group are especially preferable. It is also preferable that the carbon black used in the present invention shows pH below 6. The desirable carbon black may be achieved also by oxidizing a neutral or basic carbon black. On the other hand, if the carbon black does not have functional group such as a carboxyl group, or shows pH of above 6, the grafting may not be performed effectively.

It is preferable that the carbon content in the carbon black in the present invention is equal to 85% by weight or above. This is because if the carbon content is less than 85% by weight, the carbon black may not show an electrically conductive property.

For the polymer having a reactive group applicable to the present invention, it is not specified as long as the polymer has a reactive group that can undergo an addition reaction with the functional group on the surface of the carbon black, such as vinyl polymer, polyester, polyether, etc. Among the above listed polymers, the vinyl polymer including a main chain obtained from polymerizing vinyl monomers is preferable for the following reasons. The vinyl polymer includes a carbon—carbon bond in a main chain, and many vinyl monomers having a reactive group for grafting are known. Therefore, when the vinyl polymer is used as a polymer, the grafting to the electrically conductive carbon black can be effectively performed.

It is preferable that the reactive group in the polymer having a reactive group in the present invention is at least one kind selected from the groups consisting of epoxy groups, thioepoxy groups, aziridine groups, and oxazoline groups.

The group reactive to the functional group on the surface of the carbon black is not limited to the above listed reactive group. However, when a polymer including a reactive group other than the above listed functional groups, the problem may arise in that the kind of the carbon black available is restricted.

In the grafting of, the polymer having a reactive group, those having the above listed reactive groups are preferable for the following reasons.

Irrespectively of kinds of the carbon black, the addition reaction of the polymer having a reactive group and the carbon black can occur efficiently even under mild conditions. Also, an appropriate carbon black graft polymer suitable for the disperse-phase of the present invention can be achieved.

The method for preparing the polymer having a reactive group applicable to the present invention may be a method for polymerizing a monomer mixture including a monomer (a) having a reactive group to an electrically conductive carbon black as a main component, and also including a silicone containing macromonomer (b) represented by the formula (2) and/or another monomer (c) if necessary.

formula 2

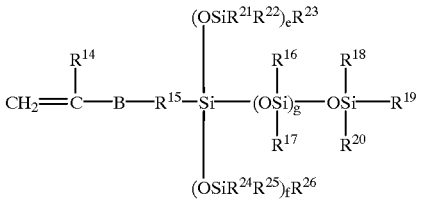

(2)

wherein B is a —COO— or phenylene group, $R^{14}$ is a hydrogen atom or methyl group, $R^{15}$ is an alkylene group having a carbon number selected from 1–6, $R^{16}$–$R^{26}$ are independently an aryl group, an alkyl group having from 1 to 6 carbon atoms or an alkoxyl group having from 1 to 10 carbon atoms, e and f are independently 0 or integers selected from 1–10, and g is 0 or an integer selected from 1–200.

The monomer (a) having a reactive group may be a polymerizable monomer including an epoxy group, that is, for example, represented by the following formulae:

formula 3

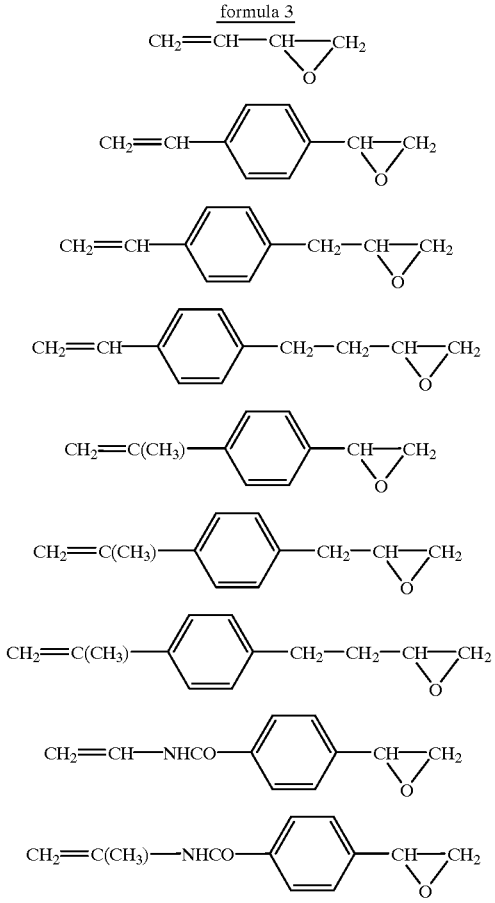

formula 4

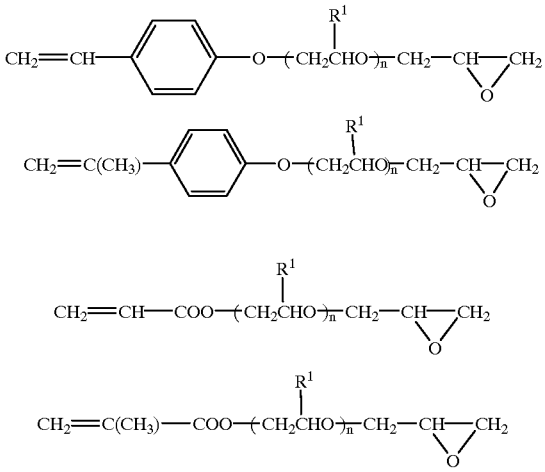

(In the formulae 3 and 4, $R^1$ is a hydrogen or methyl group, n is 0 or integer 1 or 2).

The monomer (a) may be a polymerizable monomer having a thioepocxy group, that is, for example, represented by the following formula:

formula 5

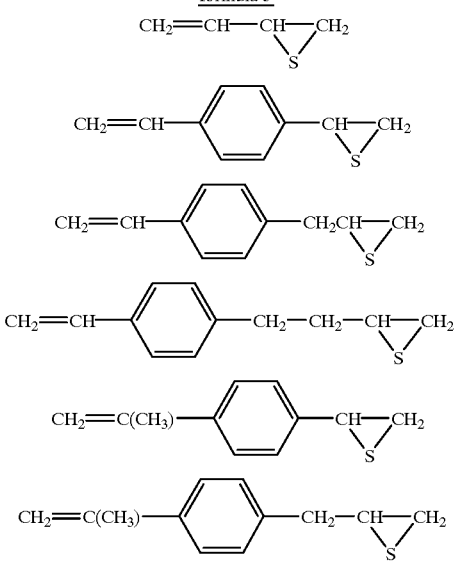

formula 6

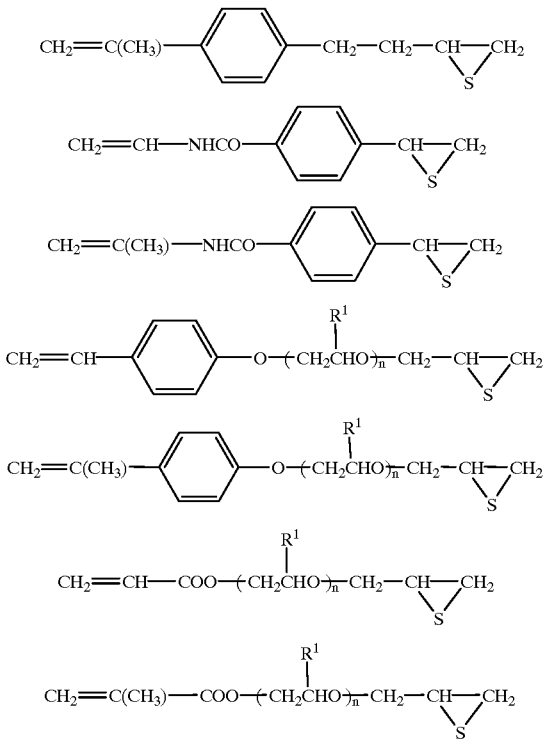

(In the formulae 5 and 6, $R_1$ is hydrogen or methyl group, n is 0 or integer 1 or 2).

The polymerizable monomer (a) may be a polymerizable monomer (a) including an oxazoline group such as 2-vinyl-2-oxazoline, 2-vinyl-4-methyl-2-oxazoline, 2-vinyl-5-methyl-2-oxazoline, 2-vinyl-4-ethyl-2oxazoline, 2-vinyl-5-ethyl-2-oxazoline, 2-isopropenyl-2-oxazoline, 2-isopropenyl-4-methyl-2-oxazoline, 2-isopropenyl-5-methyl-2-oxazoline, 2-isopropenyl-4-ethyl-2-oxazoline, 2-isopropenyl-5-ethyl-2-oxazoline, 2-isopropenyl-4,5-dimethyl-2-oxazoline, etc.

The monomer (a) may be a polymerizable monomer having an aziridine group, that is, for example, represented by the following formulae.

formula 7

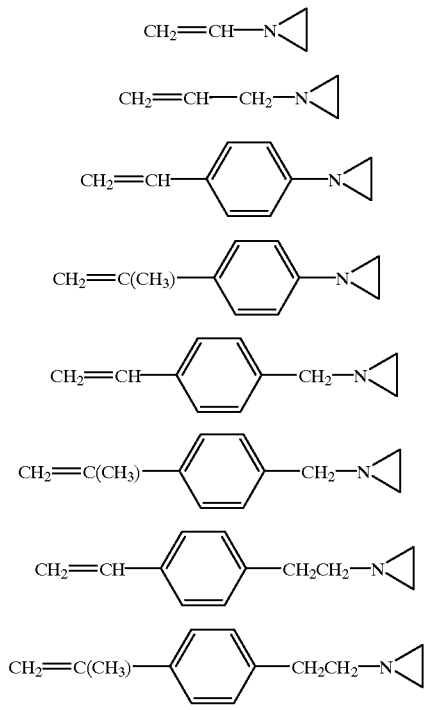

formula 8

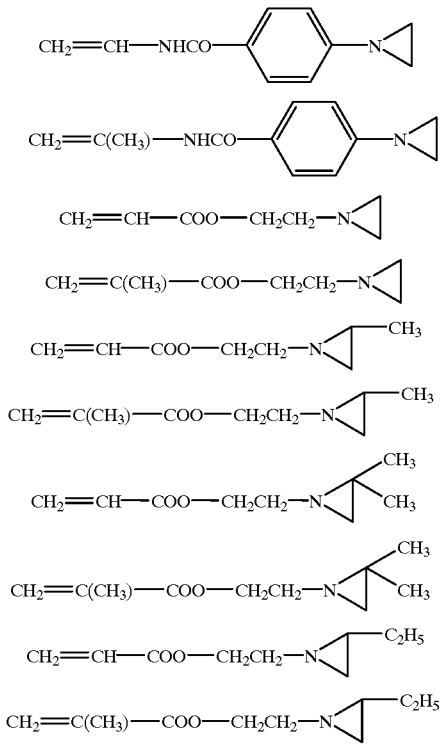

formula 9

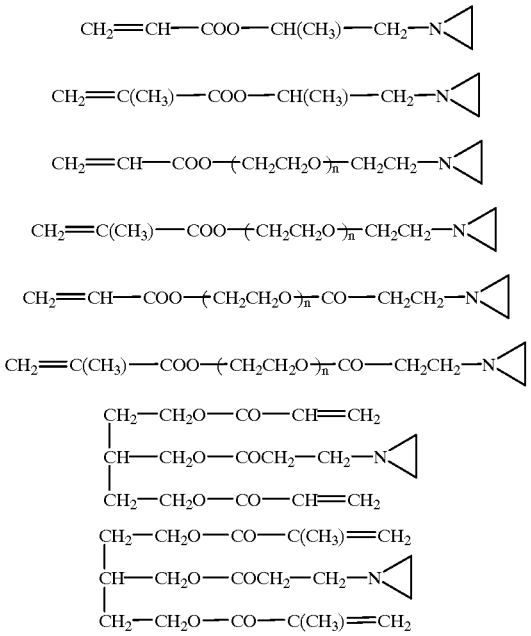

formula 10

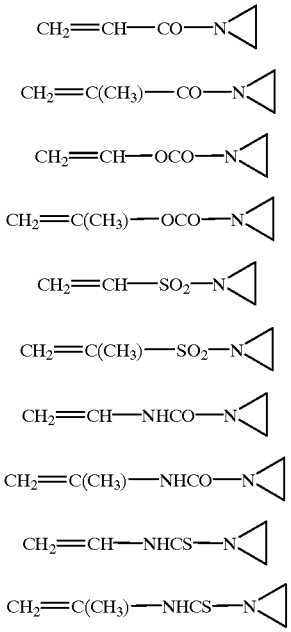

formula 11

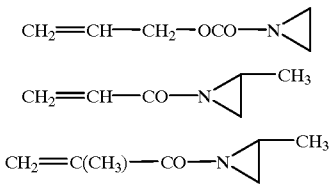

-continued

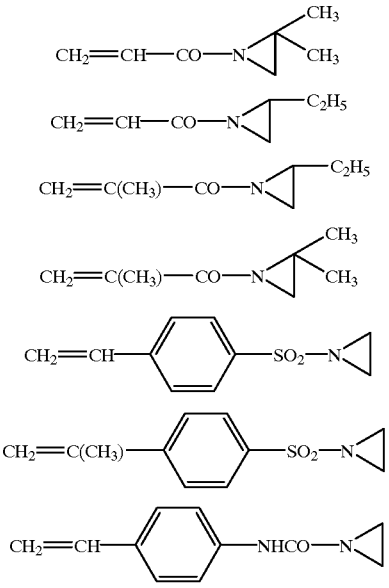

formula 12

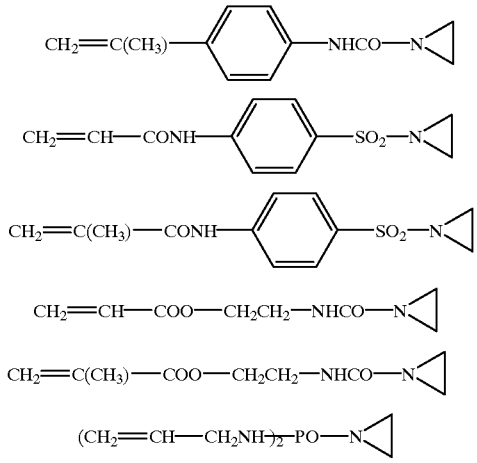

At least one kind of the above listed materials may be used.

Examples of the silicone containing macromonomer (b) represented in the formula (2) include: polymerizable polysiloxane such as polydimethylsiloxanes including (meth) acryloyl group, partially octyl substituted polydimethylsiloxanes having (meth)acryloyl, partially phenyl substituted polydimethylsiloxanes having a group, partially phenyl substituted polydimethylsiloxanes having a (meth)acryloyl group, partially phenyl substituted polydimethylsiloxanes having a styryl group, a tris(trimethylsiloxane)silylpropyl (meth)acrylate, etc.

The above listed materials can be used alone or in a mixture of two or more kinds.

Examples of the monomer (c) include: styrene derivatives such as styrene, o-methylstyrene, m-methylstyrene, p-methylstyrene, α-methylstyrene, p-methoxystyrene, p-tert-butylstyrene, p-phenyl styrene, o-chlorostyrene, m-chlorostyrene, p-chlorostyrene, etc.; (meth)acrylic derivatives such as (meth)acrylic acid, methyl(meth) acrylate, 2-ethylhexyl(meth)acrylate, stearyl(meth)acrylate, 2-ethylhexyl(meth)acrylate, etc.; ethylene; propylene; vinyl chloride, vinyl acetate, (meth)acrylonitrile, (meth) acrylamide, N-vinylpyrrolidone, N-hydroxymethyl-acrylamide, N-hydroxyethyl-acrylamide, etc. At least one kind of the above listed materials may be used.

It is preferable that the monomer mixture includes 0.1–50% by weight of the monomer (a), 0–99.9% by weight of the silicone containing macromonomer (b), and 09–9.9% by weight of the monomer (c). If the content of the monomer (a) having a reactive group is less than 0.1% by weight, the grafting may not be performed effectively. On the other hand, if the content of the monomer (a) having a reactive group is above 50% by weight, the reaction mixture after the grafting may become gel-like, and a carbon black graft polymer suitable for the present invention may not be achieved.

It is also preferable that the monomer mixture includes a silicone containing macromonomer (b) in a range of 10–99% by weight, more preferably in a range of 50–95% by weight. If the ratio of the silicone containing macromonomer (b) is less than 10% by weight, dispersion stability for the resulting electrorheological fluid composition may not be achieved. If the ratio of the silicone containing macromonomer (b) is above 99% by weight, the grafting may not be performed effectively.

In order to obtain the polymer having a reactive group, known polymerization methods can be adopted. Examples of the polymerization methods include: bulk polymerization method, suspension polymerization method, emulsion polymerization method, solution polymerization method, etc. Among them, it is preferable to adopt the solution polymerization method using a radical catalyst.

The radical catalyst is not specified as it is one of long as those used in the polymerization of normal vinyl monomers. Such radical catalyst includes: azo compounds such as 2,2'-azo-bis-isobutyronitrile, 2,2'-azo-bis-(2,4-dimethylvaleronitrile), etc.; peroxide compounds such as benzoyl peroxide, di-tert-butyl peroxide, tert-butyl peroctanoate, tert-butyl peroxy-2-ethylhexanoate, etc. The above listed catalyst is used usually in a range of 0.2–10 parts by weight to 100 parts by weight of the monomer mixture, more preferably in a range of 0.5–8 parts by weight.

The polymerization is carried out using a solution in which the monomer mixture and the catalyst is dissolved. This polymerization is performed usually in a range of 60–100° C. for 1–15 hours.

Examples of the solvent includes: aliphatic hydrocarbons such as hexane, heptane, octane, etc.; aromatic hydrocarbons such as benzene, toluene, xylene, etc.; alcohols such as isopropyl alcohol, butanol, etc.; ketones such as methylisobutylketone, methylethylketone, etc.; esters such as ethyl acetate, isobutyl acetate, amyl acetate, 2-ethylhexyl acetate, etc.; cellosolve such as methylcellosolve, ethylcellosolve, etc.

After the polymerization has been completed, the solution of the resulting polymer having a reactive group may be used for the grafting with the electrically conductive carbon black, or may be used after the solvent is removed from the polymer.

The polymer having a reactive group suitable for the present invention may be achieved in the following manner, also a compound having the reactive group to the carbon black is reacted with a precursor polymer having an active site to the compound so as to introduce the reactive group into the precursor polymer.

Examples of the compound include:

a compound having at least two above-listed reactive groups to the carbon black in the molecule;

a compound having the above-listed reactive groups to the carbon black of two kinds or more in the molecule; and a compound having at least one kind of the above-listed reactive groups to the carbon black and a functional group that is not listed above.

Here, the functional group suggests to exclude an epoxy group, a thioepoxy group, an aziridine group, and an oxazoline group, and to be reactive to the active site in the precursor polymer. Examples of such functional group include: isocyanate group, amino group, carboxyl group, hydroxyl group, vinyl group, etc.

The molecular weight of the polymer having a reactive group is not specified. However, considering the grafting effect with respect to the electrically conductive carbon black, or the performance reactive to the carbon black, it is preferable that the average molecular weight is in a rage of 500–1000000, more preferably in a range of 1000–100000.

For the disperse-phase of the electrorheological fluid composition of the present invention, it is preferable that it is obtained by the addition reaction of the polymer having a reactive group to the electrically conductive carbon black.

The methods of the grafting includes: a method for the normal addition reaction of the polymer having a reactive group to the carbon black, or a method in which the process for producing the polymer in the presence of the carbon black and the process for reacting the polymer with the carbon black are performed simultaneously. However, in order to obtain a carbon black graft polymer at high grafting efficiency, the former method is preferable.

When reacting the electrically conductive carbon black with the polymer having a reactive group, it is preferable that the ratio of the carbon black to the polymer is in a range of 100 parts by weight to 10–3000 parts by weight. If the polymer content is less than 10 parts by weight, the current density under an applied electric field becomes large. On the other hand, if the polymer content is above 3000 parts by weight, a large change in viscosity may not be achieved even under an applied electric field.

It is preferable that the reaction between the carbon black and the polymer having a reactive group is performed by mixing and stirring at a temperature range of 0–350° C. If the reaction temperature is above 350° C., the polymer may change in quality, and the current density of the electrorheological fluid composition under an applied electric field becomes large.

The addition reaction of the electrically conductive carbon black with the polymer having a reactive group may be performed without including other components. According to this method, when the carbon black in a weak aggregation is used, the aggregation is broken by degrees during the reaction and the grafting is carried out effectively. Therefore, the resulting dielectric particles are suitable for the present invention.

The addition reaction may be performed in the presence of another polymer, a polymerizable monomer, an organic solvent, etc. It is preferable that the reaction is performed in the presence of the aromatic hydrocarbons that can dissolve the polymer and has a high affinity with the carbon black, because the carbon black and the polymer having a reactive group can be quickly mixed and stirred.

The reaction of the electrically conductive carbon black with the polymer having a reactive group may be performed by use of various stirring and kneading machines.

The electrorheological fluid composition in accordance with the present invention may be prepared by mixing the dielectric particles as disperse-phase and the electrically insulating oil as a dispersion medium The ratio of the dielectric particles to the electrically insulating oil is in a range of 100 parts by weight to 100–2000 parts by weight. If the content of the electrically insulating oil is above 2000 parts by weight, a great change in the viscosity cannot be achieved under an applied electric field. On the other hand, if the amount of the electrically insulating oil is less than 100 parts by weight, the viscosity in an absence of an applied electric field increases, thereby presenting the problem that fluidity becomes poor.

In order to improve the adjustment of the viscosity, known additives such as surface active agents, polymer thickeners, etc., may be added to the electrorheological composition.

The electrorheological fluid composition in accordance with the present invention, shows a great change in viscosity and excellent current property under an applied electric field, and shows excellent dispersion stability and fluidity in an absence of an electric field. The electrorheological fluid composition can be manufactured at low price. Therefore the electrorheological fluid composition can be applied to a variety of driving devices such as an engine mount, a clutch, a damper, a brake, a shock absorber, a valve, a cylinder, an inkjet using an electrorheological fluid, etc.

For a fuller understanding of the nature and advantages of the invention, reference should be made to the ensuing detailed description taken in conjunction with the accompanying drawings.

DESCRIPTION OF THE EMBODIMENTS

Figure 1:
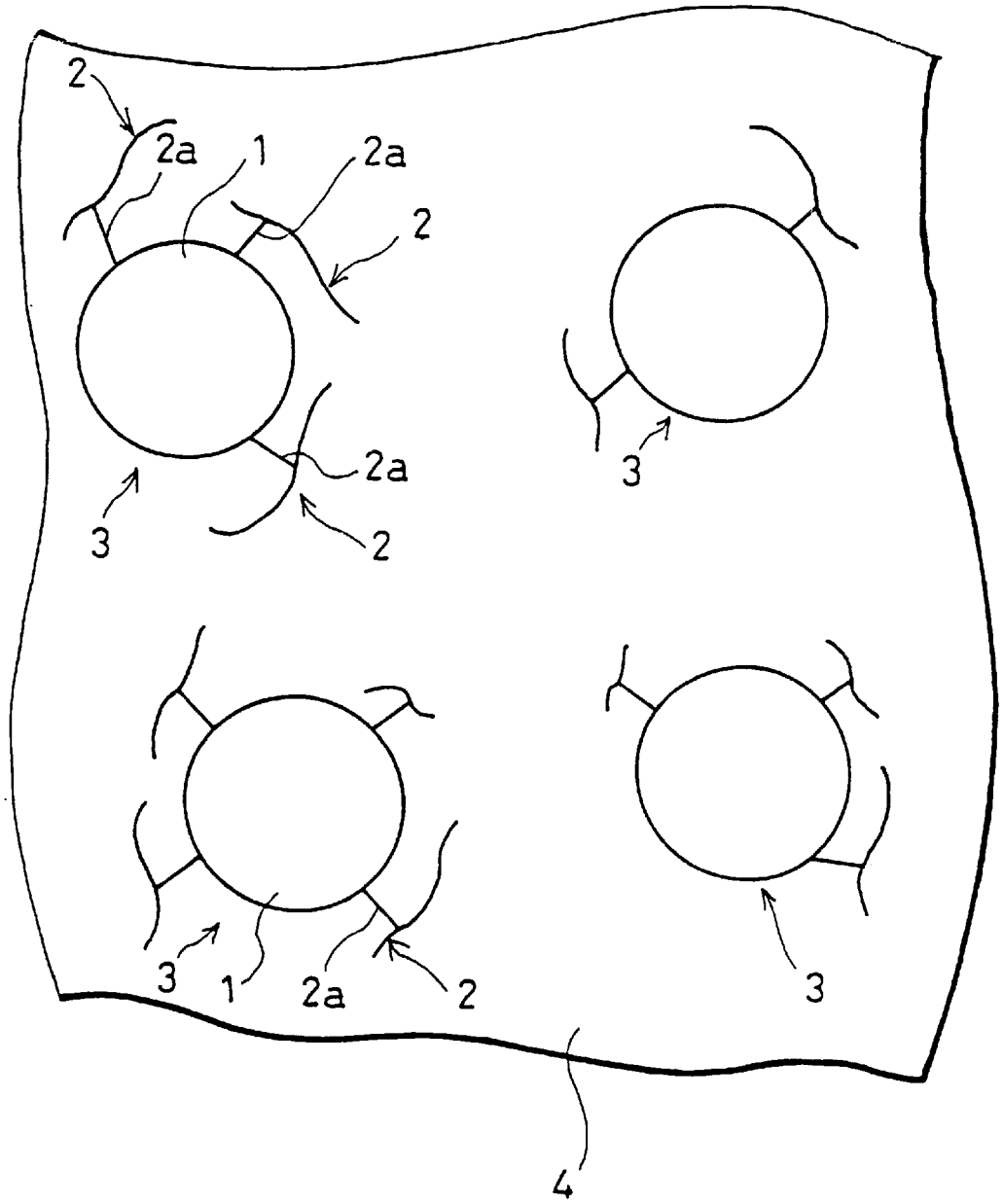
FIG. 1 is a view showing a schematic configuration of an electrorheological fluid composition in accordance with the present invention.

The electrorheological fluid composition in accordance with the present invention will be explained below with respect to examples and comparative examples. It should be noted, however, the scope of the present invention is not limited only to these examples.

The electrorheological fluid composition comprises dielectric particles as a disperse-phase and an electrically insulating oil as a dispersion medium, wherein said dielectric particle has a polymer portion and an electrically conductive carbon black portion, and said polymer portion is grafted on said carbon black portion.

First, examples of carbon black graft polymers as dielectric particles will be explained with respect to Referential Examples 1–5.

REFERENTIAL EXAMPLE 1

In a flask provided with a stirrer, an inactive gas introducing tube, a reflux condenser and a thermometer, 400 parts by weight of deionized water wherein 0.2 parts by weight of polyvinyl alcohol was dissolved was put. To this solution, a monomer mixture composed of 193 parts by weight of styrene and 7 parts by weight of glycidyl methacrylate, wherein 14 parts by weight of benzoyl peroxide was dissolved, was added. Then, the content in the flask were stirred at high speed, so as to obtain an uniform suspension.

The suspension was heated to 80° C. while introducing therein a nitrogen gas, and a polymerization was carried out while stirring the content for six hours. Then, the contents were cooled off, and the resulting polymer suspension was filtered off and washed with water, thereby obtaining a polymer having an epoxy group in the molecule as a reactive group. The resulting polymer had an average molecular weight of Mn=6500 as a result of measurement by the GPC (Gel Permeation Chromatography).

Then, 50 parts by weight of the resulting polymer and 50 parts by weight of carbon black MA-100R (with an average particle diameter of 22 mμ and pH=3.5 available from Mitsubishi Chemical Industries Ltd.) were kneaded at 160° C. using a kneader at 100 r.p.m. Thereafter, the reaction product was pulverized, thereby obtaining a carbon black graft polymer (1). Here, Mμ indicates $10^{-9}$ meter.

REFERENTIAL EXAMPLE 2

In the flask used in the Referential Example 1, 400 parts by weight of deionized water wherein 0.2 parts by weight of polyvinyl alcohol was dissolved was put. To this solution, a monomer mixture composed of 44 parts by weight of methyl methacrylate, 150 parts by weight of butyl acrylate, and 6 parts by weight of 2,3-epithiopropyl methacrylate, wherein 15 parts by weight of benzoyl peroxide was dissolved, was added. Then, the contents in the flask were stirred at high speed so as to obtain a uniform suspension.

The suspension was heated to 80° C. while introducing therein a nitrogen gas, and a polymerization was carried out while stirring the content for six hours. Then, the content was cooled off, and the resulting polymer suspension was filtered off and washed with water, thereby obtaining a polymer having a thioepoxy group in the molecule as a reactive group. The resulting polymer had an average molecular weight of Mn=6100 as a result of measurement by the GPC.

Then, 60 parts by weight of the resulting polymer and 15 parts by weight of carbon black MA-100 were kneaded at 160° C. using the kneader used in Referential Example 1 at 100 r.p.m. Thereafter, the reaction product was pulverized, thereby obtaining a carbon black graft polymer (2).

REFERENTIAL EXAMPLE 3

In the flask used in the Referential Example 1, 400 parts by weight of isopropyl alcohol was put therein. A monomer mixture composed of 34 parts by weight of methyl methacrylate, 20 parts by weight of styrene, 40 parts by weight of butyl acrylate, and 100 parts by weight of polydimethyl siloxane (Sairapurehn FM0721 with an average molecular weight=around 5000 available from Chisso Corporation), and 6 parts by weight of glycidyl acrylate, wherein 15 parts by weight of benzoyl peroxide was dissolved, was added. Then, the contents in the flask were stirred at high speed, so as to obtain a uniform solution.

The solution was heated to 80° C. while introducing therein a nitrogen gas, and a polymerization was carried out while stirring the content for six hours. After the solvent in the polymer solution was removed, the reaction product was dried and a polymer including an epoxy group in the particle as a reactive group was obtained. The resulting polymer had an average molecular weight of Mn=10000 as a result of measurement by the GPC.

Then, 60 parts by weight of the resulting polymer and 15 parts by weight of carbon black MA-7 (with an average particle diameter of 24 mμ and pH=3.0, available from Mitsubishi Chemical Industries Ltd.) were kneaded at 160° C. using the kneader used in Referential Example 1 at 100 r.p.m. Thereafter, the reaction product was pulverized, thereby obtaining a carbon black graft polymer (3).

REFERENTIAL EXAMPLE 4

In the flask used in the Referential Example 1, 400 parts by weight of deionized water wherein 0.2 parts by weight of polyvinyl alcohol was put. To this solution, a monomer mixture composed of 145 parts by weight of styrene, 50 parts by weight of p-chlorostyrene, and 5 parts by weight of isopropenyl oxazoline, wherein 15 parts by weight of benzoyl peroxide was dissolved, was added. Then, the contents in the flask were stirred at high speed, so as to obtain a uniform solution.

The solution was heated to 80° C. while introducing therein a nitrogen gas, and a polymerization was carried out while stirring the content for six hours. Then, the contents were cooled off, and the resulting polymer suspension was filtered off and washed with water, so as to obtain a polymer having an oxazoline group in the molecule as a reactive group. The resulting polymer had an average molecular weight of Mn=5100 as a result of measurement by the GPC.

Then, 60 parts by weight of the resulting polymer and 20 parts by weight of carbon black MA-600 (with an average diameter of 18 mμ and pH=7.5, available from Mitsubishi Chemical Industries Ltd.) were kneaded at 160° C. using the kneader used in Referential Example 1 at 100 r.p.m. Thereafter, the reaction product was pulverized, thereby obtaining a carbon black graft polymer (4).

REFERENTIAL EXAMPLE 5

In the flask used in the Referential Example 1, 200 parts by weight of toluene and 200 parts by weight of methyl isobutyl ketone was put. A monomer mixture composed of 30 parts by weight of methyl acrylate, 150 parts by weight of styrene, 10 parts by weight of stearyl acrylate and 10 parts by weight of 2-(1-aziridinyl)ethyl methacrylate, wherein 5 parts by weight of benzoyl peroxide was dissolved, was prepared. Then, the mixture was dropped in the flask by a dropping funnel for two hours.

The solution was heated to 80° C. while introducing therein a nitrogen gas, and a polymerization was carried out while stirring the contents for six hours. Then, the contents were cooled off. To the resulting polymer solution, methanol was added, and the precipitation occurred again. Then, the polymer solution was dried so as to obtain a polymer having a aziridine group in the molecule as a reactive group. The resulting polymer had an average molecular weight of Mn=4500 as a result of measurement by the GPC.

Then, 80 parts by weight of the resulting polymer and 20 parts by weight of carbon black MA-600 (see Referential Example 4) were kneaded at 160° C. using the kneader used in Referential Example 1 at 100 r.p.m. Thereafter, the reaction product was pulverized, thereby obtaining a carbon black graft polymer (5).

Next, the electrorheological fluid compositions of the present invention wherein the carbon black graft polymers (1)–(5) as disperse-phase were dispersed in the dispersion medium will be explained below.

EXAMPLE 1

15 parts by weight of the carbon black graft polymer (1) prepared in Referential Example 1 were mixed and dispersed in 85 parts by weight of toluene, thereby obtaining the electrorheological fluid composition (1) of the present invention.

The average particle diameter of the solid particle (1) was measured by a particle size distribution analyzer, and was found to have an average particle diameter of 0.045 μm. Here, μm indicates $10^{-6}$ meter.

EXAMPLE 2

20 parts by weight of the carbon black graft polymer (2) prepared in Referential Example 2 were mixed and dispersed in 80 parts by weight of ethyl benzoate, thereby obtaining the electrorheological fluid composition (2) of the present invention.

The average particle diameter of the solid particle (2) was measured, and was found to have an average particle diameter of 0.14 μm.

EXAMPLE 3

15 parts by weight of the carbon black graft polymer (3) prepared in Referential Example 3 were mixed and dispersed in 85 parts by weight of silicone oil having a kinematic viscosity of $10\times10^{-6}$ $m^2/s$ (KF96-10cS available from Shin-etsu Chemical Industry Co., Ltd.), thereby obtaining the electrorheological fluid composition (3) of the present invention.

The average particle diameter of the carbon black graft polymer (3) in the composition (3) was measured by a particle size distribution analyzer, and was found to have an average particle diameter of 0.12 μm.

EXAMPLE 4

20 parts by weight of the carbon black graft polymer (4) prepared in Referential Example 4 were mixed and dispersed in 80 parts by weight of ethylbenzene, thereby obtaining the electrorheological fliud composition (4) of the present invention.

The average particle diameter of the solid particle (4) was measured, and was found to have an average diameter of 0.15 μm.

EXAMPLE 5

15 parts by weight of the carbon black graft polymer (5) prepared in Referential Example 5 were mixed dispersed in 85 parts by weight of toluene, thereby obtaining the electrorheological fluid composition (5) of the present invention.

The average particle diameter of the solid particle (5) was measured, and was found to have an average diameter of 0.16 μm.

COMPARATIVE EXAMPLE 1

15 parts by weight of carbon black MA-100R were mixed in 85 parts by weight of toluene, and the comparative fluid composition (1) was obtained. The carbon black MA-100R was not dispersed in toluene, and was aggregated.

COMPARATIVE EXAMPLE 2

15 parts by weight of carbon black MA-7 were mixed85 parts by weight of kinematic viscosity $10\times10^{-6}$ $m^2/s$ of silicone oil (KF96-10cS available from The Shin-etsu Chemical Industry Co., Ltd.), and the comparative fluid composition(2) was obtained. The carbon black MA-7 was not dispersed in silicone oil, and was aggregated.

The electrorheological fluid compositions (1)–(5) prepared in Examples 1–5 and the comparative fluid compositions (1) and (2) obtained from Comparative Examples 1 and 2 were severally measured for viscosity without applying an electric field at 25° C.

Then, the electrorheological fluids were severally measured for dispersion stability. The described measurements were performed under the following conditions: each composition was put in the examination tube with a height of 150 mm and a diameter of 15 mm to the height of 100 m, and the examination tube was left at room temperature, and the settlement condition over time of the dispersed-phase particles were observed. After the examination tube was left under the described conditions for a month, the dispersion stability of each composition was evaluated. The results of the measurements are shown in Table 1.

Next, each composition was measured for changes in viscosity under an applied electric field in the following manner. Each composition was placed in the coaxial field rotational viscometer with electric fields with a clearance between inner and outer cylinders of 1.0 mm at a shear rate of 100/s, and both the shear stress ($P_E$) in an absence of an electric field and the shear stress ($P_O$) under an applied AC electric field of 2 kV/mm were measured. The ratio ($P_E/P_O$) suggests relative changes in viscosity. When the electric field was applied, the current density was measured as shown in Table 1.

TABLE 1

| | Viscosity (Pa · s) | Dispersion Stability | Relative Changes in Viscosity | Current Density ($\mu A/cm^2$) |
|---|---|---|---|---|
| Example ER fluid composition | | | | |
| (1) | 0.028 | A | 4.3 | 3.5 |
| (2) | 0.035 | A | 2.5 | 2.6 |
| (3) | 0.030 | A | 2.9 | 1.7 |
| (4) | 0.036 | A | 3.1 | 2.0 |
| (5) | 0.036 | A | 3.1 | 3.4 |
| Comparative fluid composition | | | | |
| (1) | *1 | *1 | *1 | *2 |
| (2) | *1 | *1 | *1 | *2 |

In Table 1, A indicates that the disperse-phase particles did not settle after a period of 1 month, and the disperse-phase particles maintained uniform conditions in the dispersion medium.
*1 indicates that the settlement and aggregation of carbon black occurred, and uniform conditions of the fluid was not achieved. Thus, the property could not be measured.
*2 indicates that the dielectric break down occurred, and an electric field of 2 kV/mm could not be applied.

As clearly shown in Table 1, the electrorheological fluid compositions (1)–(5) of the present invention showed a great change in the viscosity under an applied electric field, and the resulting current density was small. Moreover, the viscosities of the electrorheological fluid compositions (1)–(5) in an absence of the electric field was extremely small (0.04 Pa·s or below). Furthermore, the settlement of the disperse-phase particles of the electrorheological fluid compositions (1)–(5) of the present invention did not occur even after a period of one month, and excellent dispersion stability was endowed.

On the other hand, the carbon black in the comparative fluid compositions (1) and (2) were was aggregated without being dispersed in the dispersion medium, and the comparative fluid compositions (1) and (2) showed very poor dispersion stability. Moreover, an electric field of 2 kV/mm could not be applied to the comparative fluid compositions (1) and (2) due to the insulating break down.

Other examples of the disperse-phase particles in the electrorheological fluid compositions will be explained with respect to Referential Examples 6–12.

REFERENTIAL EXAMPLE 6

In a four neck flask provided with a thermometer, a stirring blade and a cooling tube, 200 parts by weight of toluene were placed. In the flask, a mixture of 190 parts of polydimethylsiloxane having a methacryloyl group (Sairapurehn FM0721 and available from Chisso Corporation with an average molecular weight=around 5000), 10 parts by weight of glycidyl methacrylate and 15 parts by weight of benzoyl peroxide was added, and the contents in the flask were stirred so as to obtain a uniform solution. The resulting solution was heated to 70° C., and a polymerization reaction was carried out for 4 hours. The solvent in the resulting polymer solution was removed under reduced pressure, and a polymer having an epoxy group in the molecule was obtained. The average molecular weight of the polymer was measured by the GPC, and was found to be Mn=10000.

In a separable flask provided with a thermometer, a stirring blade and a cooling tube, 40 parts by weight of the resulting polymer and 20 parts by weight of carbon black MA-100 R were dispersed, and 200 parts by weight of xylene and 2000 parts by weight of SUS beads were added in the flask. Then, the contents in the flask were stirred at 600 r.p.m, and a reaction was carried out for three hours at 160° C. After the reaction was completed, the reaction product was separated from the SUS beads, and the solvent in the reaction product was removed under reduced pressure. Thereafter, the reaction product was completely dried by a vacuum pump, and a carbon black graft polymer (6) was obtained.

REFERENTIAL EXAMPLE 7

In the same manner as Referential Example 6, in a four-neck flask 200 parts by weight of toluene w ere placed. In the flask, a mixture of 195 parts of polydimethyl siloxane having a methacryloyl group (Sairapurehn FM0711 with an average molecular weight=around 10001 available from Chisso Corporation), 5 parts by weight of glicidyl methacrylate and 5 parts by weight of azo-bis-isobutyronitrile was added, and the contents in the flask was stirred so as to obtain a uniform solution. The resulting solution was heated to 65° C., and a polymerization was carried out for 4 hours. The solvent in the resulting polymer solution was removed under reduced pressure, and a polymer having an epoxy group in the molecule was obtained. The average molecular weight of the polymer was measured by the GPC, and was found to be Mn=7000.

In the separable flask, 40 parts by weight of the resulting polymer and 20 parts by weight of carbon black MA-100 R were dispersed, and 200 parts by weight of xylene and 2000 parts by weight of SUS beads were placed. Then, the contents in the flask were stirred at 600 r.p.m, and a reaction was carried out for three hours at 160° C. After the reaction was completed, the reaction product was separated from the SUS beads, the solvent in the reaction product was removed under reduced pressure. Thereafter, the reaction product was completely dried by a vacuum pump, and a carbon black graft polymer (7) was obtained.

REFERENTIAL EXAMPLE 8

In the same manner as Referential Examples, in a four-neck flask, 200 parts by weight of toluene were placed. In the flask, a mixture of 90 parts of polydimethylsiloxane having a methacryloyl group (Sairapurehn FM0721 and available from Chisso Corporation with an average molecular weight=around 5000), 90 parts by weight of styrene, 20 parts by weight of glycidyl acrylate and 10 parts by weight of benzoyl peroxide was added, and the contents in the flask were stirred so as to obtain a uniform solution. The resulting solution was heated to 65° C., and a polymerization reaction was carried out for 4 hours. The solvent in the resulting polymer solution was removed under reduced pressure, and a polymer having an epoxy group in the molecule was obtained. The average molecular weight of the polymer was measured by the GPC, and was found to be Mn=8000.

In the same manner as Referential Example 6, 40 parts by weight of the resulting polymer and 40 parts by weight of carbon black MA-100 R and 200 parts by weight of xylene were dispersed, and 2000 parts by weight of SUS beads were placed. Then, the contents in the flask were stirred at 600 r.p.m, and a reaction was carried out for three hours at 160° C. After the reaction was completed, the reaction product was separated from the SUS beads, the solvent in the reaction product was removed under reduced pressure. Thereafter, the reaction product was completely dried by a vacuum pump, and a carbon black graft polymer (8) was obtained.

REFERENTIAL EXAMPLE 9

In the same manner as the Referential Example 6, in a four neck flask, 200 parts by weight of toluene were placed. In the flask, a mixture of 170 parts of polydimethyl siloxane having a methacryloyl group (Sairapurehn FM0721 and available from Chisso Corporation with an average molecular weight=around 5000), 20 parts by weight of methylmethacrylate, 10 parts by weight of glycidyl methacrylate and 10 parts by weight of benzoyl peroxide was added, and the contents in the flask were stirred so as to obtain a uniform solution. The resulting solution was heated to 65° C., and a polymerization was carried out for 4 hours. The solvent in the resulting polymer solution was removed under reduced pressure, and a polymer having an epoxy group in the molecule was obtained. The average molecular weight of the polymer was measured by the GPC, and was found to be Mn=7000.

In the separable flask, 40 parts by weight of the resulting polymer and 20 parts by weight of carbon black MA-600 were dispersed, 200 parts by weight of xylene and 2000 parts by weight of SUS beads were added in the flask. Then, the contents in the flask were stirred at 600 r.p.m, and a reaction was carried out for three hours at 160° C. After the reaction was completed, the reaction product was separated from the SUS beads, and the solvent in the reaction product was removed under reduced pressure. Thereafter, the reaction product was completely dried by a vacuum pump, and a carbon black graft polymer (9) was obtained.

REFERENTIAL EXAMPLE 10

In the same manner as the Referential Example 6, in a four neck flask, 200 parts by weight of toluene were placed. In the flask, a mixture of 180 parts by weight of tris(trimethyl siloxy)silylpropyl methacrylate (X-22-5002 available from Shin-etsu Chemical Industry Co. Ltd. with an average molecular weight=around 422), 15 parts by weight of styrene, 5 parts by weight of glycidyl methacrylate and 5 parts by weight of azo-bis-isobutyronitrile was added, and the contents in the flask was stirred so as to obtain a uniform solution. The resulting solution was heated to 65° C., and a polymerization was carried out for 4 hours. The solvent in the resulting polymer solution was removed under reduced pressure, and a polymer having an epoxy group in the molecule was obtained. The average molecular weight of the polymer was measured by the GPC, and was found to be Mn=6000.

In the separable flask, 40 parts by weight of the resulting polymer and 20 parts by weight of carbon black MA-100R were dispersed, and 200 parts by weight of xylene and 2000 parts by weight of SUS beads were placed. Then, the contents in the flask were stirred at 600 r.p.m., and a reaction was carried out for three hours at 160° C. After the reaction was completed, the reaction product was separated from the SUS beads, the solvent in the reaction product was removed under reduced pressure. Thereafter, the reaction product was completely dried by a vacuum pump, and a carbon black graft polymer (10) was obtained.

REFERENTIAL EXAMPLE 11

In the same manner as the Referential Example 6, in a four-neck flask, 200 parts by weight of toluene were placed. In the flask, a mixture of 180 parts of polydimethyl siloxane having a methacryloyl group (Sairapurehn FM0721 and available from Chisso Corporation with an average molecular weight=around 5000), 10 parts by weight of styrene, 10 parts by weight of isopropenyl oxazoline and 5 parts by weight of azo-bis-isobutyronitrile was added, and the contents in the flask were stirred so as to obtain a uniform solution. The resulting solution was heated to 65° C., and a polymerization was carried out for 4 hours. The solvent in the resulting polymer solution was removed under reduced pressure, and a polymer having an oxazoline group in the molecule was obtained. The average molecular weight of the polymer was measured by the GPC, and was found to be Mn=7000.

In the separable flask, 40 parts by weight of the resulting polymer and 20 parts by weight of carbon black MA-100R were dispersed, and then 200 parts by weight of xylene and 2000 parts by weight of SUS beads were added. Then, the contents in the flask were stirred at 600 r.p.m, and a reaction was carried out for three hours at 160° C. After the reaction was completed, the reaction product was separated from the SUS beads, the solvent in the reaction product was removed under reduced pressure. Thereafter, the reaction product was completely dried by a vacuum pump, and a carbon black graft polymer (11) was obtained.

EXAMPLE 6

30 parts by weight of the carbon black graft polymer (6) prepared in Referential Example 6 were mixed and dispersed in 70 parts by weight of silicone oil (KF96-20CS available from Shin-etsu Chemical Industry Co., Ltd.), thereby obtaining the electrorheological fluid composition (6) of the present invention.

The average particle diameter of the solid particle in the composition (6) was measured by a particle size distribution analyzer, and was found to have an average particle diameter of 0.12 $\mu$m.

EXAMPLE 7

30 parts by weight of the carbon black graft polymer (7) prepared in Referential Example 7 were mixed and dispersed in 70 parts by weight of silicone oil (KF96-20CS available from Shin-etsu Chemical Industry Co., Ltd.), thereby obtaining the electrorheological fluid composition (7) of the present invention.

The average particle diameter of the solid particle in the composition (7) was measured, and was found to have an average particle diameter of 0.09 $\mu$m.

EXAMPLE 8

30 parts by weight of the carbon black graft polymer (8) prepared in Referential Example 8 were mixed and dispersed in 70 parts by weight of an electric insulating oil containing mainly mineral hydrocarbon (high voltage insulating oil, available from Cosmo Oil Company Ltd.), thereby obtaining the electrorheological fluid composition (8) of the present invention.

The average particle diameter of the solid particle in the composition (8) was measured, and was found to have an average particle diameter of 0.08 μm.

EXAMPLE 9

30 parts by weight of the carbon black graft polymer (9) prepared in Referential Example 9 were mixed and dispersed in 70 parts by weight of silicone oil (KF96-20CS available from Shin-etsu Chemical Industry Co., Ltd.), thereby obtaining the electrorheological fluid composition (9) of the present invention.

The average particle diameter of the solid particle in the composition (9) was measured, and was found to have an average particle diameter of 0.12 μm.

EXAMPLE 10

30 parts by weight of the carbon black graft polymer (10) prepared in Referential Example 10 was mixed and dispersed in 70 parts by weight of silicone oil (KF96-20CS available from Shin-etsu Chemical Industry Co., Ltd.), thereby obtaining the electrorheological fluid composition in the composition (10) of the present invention.

The average particle diameter of the solid particle (10) was measured, and was found to have an average particle diameter of 0.12 μm.

EXAMPLE 11

30 parts by weight of the carbon black graft polymer (11) prepared in Referential Example 11 were mixed and dispersed in 70 parts by weight of silicone oil (KF96-20CS available from Shin-etsu Chemical Industry Co., Ltd.), thereby obtaining the electrorheological fluid composition (11) of the present invention.

The average particle diameter of the carbon black graft polymer in the composition (11) was measured, and was found to have an average particle diameter of 0.09 μm.

Example of dielectric particles used in the comparative fluid compositions will be explained with respect to Referential Examples 12 and 13.

REFERENTIAL EXAMPLE 12

In the flask used in Referential Example 6, 200 parts by weight of toluene were placed, and a mixture of 110 parts of polydimethylsiloxane having a methacryloyl group (Sairapurehn FM0721 and available from Chisso Corporation with an average molecular weight=around 5000), 90 parts by weight of styrene, 10 parts by weight of benzoyl peroxide was added, and the contents in the flask were stirred so as to obtain a uniform solution. The resulting solution was heated to 65° C., and a polymerization was carried out for 4 hours. The solvent in the resulting polymer solution was removed under reduced pressure, and the polymer was obtained. The average molecular weight of the polymer was measured by the GPC, and was found to be Mn=7000.

REFERENTIAL EXAMPLE 13

20 parts by weight of carbon black MA-7 were dispersed in 200 parts by weight of toluene, and 1 part by weight of phenyltriethoxysilane dissolved in the mixing solution of xylene and ethanol was added thereto. After a small amount of water was added, the mixture was heated to 80° C. for 3 hours, and the reaction was performed. After the reaction was completed, the solvent was removed under reduced pressure, and the resultant mixture was dried, resulting in the agglomeration of the solid carbon black.

Other examples of comparative fluid compositions using non-decorated carbon black as dielectric particles will be explained with resect to Comparative Examples 3 and 4. Other Examples of comparative fluid compositions using dielectric particles prepared in Referential Examples 12 and 13 will be explained with respect to Comparative Examples 5 and 6.

COMPARATIVE EXAMPLE 3

15 parts by weight of carbon black MA-100R were mixed in 85 parts by weight of $20\times10^{-6}$ $m^2/s$ silicone oil (KF96-20CS available from Shin-etsu Chemical Industry Co., Ltd.), and the comparative fluid composition (3) was obtained. The carbon black MA-100R was aggregated without being dispersed in silicone oil.

COMPARATIVE EXAMPLE 4

15 parts by weight of carbon black MA-100R were mixed in 85 parts by weight of mineral electrically insulating oil (high voltage insulating oil, available from Cosmo Oil company Ltd.), and the comparative fluid composition (4) was obtained. The carbon black MA-100R was aggregated without being dispersed in an electric insulating oil containing mainly mineral hydrocarbon.

COMPARATIVE EXAMPLE 5

20 parts by weight of the graft polymer prepared in Referential Example 12 and 10 parts by weight of carbon black MA-100R were mixed in 70 parts by weight of $20\times10^{-6}$ $m^2/s$ silicone oil (KF96-20CS available from Shin-etsu Chemical Industry Co., Ltd.), and the comparative fluid composition (5) was obtained.

COMPARATIVE EXAMPLE 6

20 parts by weight of the agglomerate of the carbon black prepared in Referential Example 13 was mixed in 80 parts by weight of $20\times10^{-6}$ $m^2/s$ silicone oil (KF96-20CS available from Shin-etsu Chemical Industry Co., Ltd.), and the comparative fluid composition (6) was obtained. The carbon black was aggregated without being dispersed in silicone oil.

COMPARATIVE EXAMPLE 7

Deionized water was added to 20 parts by weight of carbon black MA-600, and was stirred by a stirrer at 10000 r.p.m. After the mixture was thoroughly dispersed, a solution in which 0.5 parts by weight of γ-amino propyl triethoxysilane (silane coupling agent) was dissolved in 200 ml of methanol was added, and was further stirred by a dispersing device at 10000 r.p.m. In this manner, the γ-amino propyl triethoxysilane was reacted to a hydroxyl group on the surface of the carbon black via a γ-aminotrihydroxysilane. Then, the resultant mixture was washed with water so as to remove an excessive amount of silane coupling agent, and was dried.

20 parts by weight of the carbon black particles treated with γ-amino propyl triethoxysilane, 10 parts by weight of one side reactive silicone oil having a terminal epoxy groups, and 70 parts by weight of silicone oil (dispersion medium) (KF96-20CS available from Shin-etsu Chemical Industry Co. Ltd.) was pulverized and mixed using a bowl mill for three hours, thereby obtaining the comparative fluid composition (7).

The electrorheological fluid compositions (6)–(11) prepared in Examples 6–11 and the comparative fluid compositions (3)–(7) obtained from Comparative Examples 3–7 were severally measured for viscosity without applying an electric field at 25° C. The results of the measurements are shown in Table 2.

For dispersion stability, relative changes in viscosity and current density of the electrorheological fluid compositions (6)–(11) and comparative fluid compositions (3)–(7) are measured in the same manner as the previous measurements. The results of measurements are shown in Table 2.

TABLE 2

| | Viscosity (Pa · s) | Dispersion Stability | Relative Changes in Viscosity | Current Density (μA/cm) |
|---|---|---|---|---|
| Example ER fluid composition | | | | |
| (6) | 0.035 | A | 10.2 | 9.7 |
| (7) | 0.036 | A | 9.5 | 8.3 |
| (8) | 0.060 | A | 13.0 | 11.3 |
| (9) | 0.055 | A | 12.3 | 10.9 |
| (10) | 0.072 | A | 11.3 | 9.9 |
| (11) | 0.043 | A | 11.9 | 10.6 |
| Comparative fluid composition | | | | |
| (3) | *1 | *1 | *1 | *2 |
| (4) | *1 | *1 | *1 | *2 |
| (5) | 0.025 | B | *1 | *2 |
| (6) | *1 | *1 | *1 | *2 |
| (7) | 0.040 | B | *2 | *2 |

In Table 2, B indicates that supernatant was generated in the composition due to the settlement of disperse-phase particles after a period of 1 month.

As clearly shown in Table 2, the electrorheological fluid compositions (6)–(11) of the present invention showed a great change in the viscosity under an applied electric field, and the resulting current density was small. Moreover, the respective viscosities in an absence of the electric field was extremely small (0.1 Pa·s or below), and showed excellent fluidity. Furthermore, the settlement of the disperse-phase particles of the electrorheological fluid compositions (6)–(11) of the present invention did not occur even after a period of one month, and excellent dispersion stability was endowed.

On the other hand, carbon black in the comparative fluid compositions (3), (4) and (6) were aggregated without being dispersed in the dispersion medium, and the comparative fluid compositions (1) and (2) showed poor dispersion stability. The comparative fluid compositions (5) and (7) were once dispersed in the dispersion medium; however, after a period of one month, the supernatant liquid was generated due to the settlement. Moreover, an electric field of 2 kV/mm could not be applied to the comparative fluid compositions (3)–(7) due to the insulating break down.

The properties of the composition in each Example is thought to be achieved for the following reason. As shown in FIG. 1, each composition includes a dielectric particle 3 composed of a carbon black portion 1 and a polymer portion 2, and the dielectric particle 3 is dispersed in an oil 4 having an electrically insulating property. The polymer portion 2 includes a polymer having carbon—carbon bonds.

Furthermore, the dielectric particle 3 includes a portion 2*a* where the polymer portion 2 and the carbon black portion 1 are chemically bonded. The portion 2*a* is formed by reacting a reactive group such as an epoxy group in the polymer portion 2 to a carboxyl group of the carbon black portion 1.

Because the carbon black portion 1 and the polymer portion 2 are chemically bonded in the dielectric particle 3, where the polymer portion 2 extends from the surface of the carbon black portion 1 into the oil 4, the polymer portion 2 can be placed among the carbon black portions 1 of the dielectric particles 2 in a stable state.

As a result, in the oil 4, the aggregation of the dielectric particle 3 can be prevented, whereby the composition has excellent dispersion stability.

Moreover, the contact between electrically conductive carbon black portions 1 can be avoided by a polymer portion 2, the electrically insulating breakdown of the composition under an applied electric field can be prevented.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. An electrorheological fluid composition comprising dielectric particles as a disperse-phase and an electrically insulating oil as a dispersion medium, wherein said dielectric particles have an average particle diameter in a range of 0.001–0.5 μm and a polymer portion and an electrically conductive carbon black portion, said polymer portion including a main chain obtained by polymerizing a vinyl monomer and a silicone containing component and being grafted on said carbon black portion, wherein said polymer portion has an affinity to said dispersion medium and a ratio of said polymer portion to said electrically conductive carbon black portion is in a range of 10–3,000 parts by weight to 100 parts by weight; and wherein said silicone containing component has a polysiloxane containing structure unit represented by the formula:

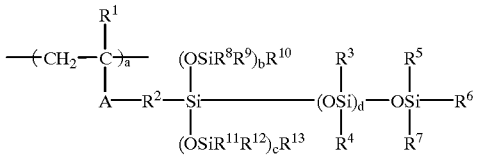

wherein, A is —COO—, $R^1$ is hydrogen atom or methyl group, $R^2$ is an alkylene group having from 1 to 6 carbon atoms, $R^{3-R13}$ are independently an aryl group, an alkyl group having from 1 to 6 carbon atoms or an alkoxy group having from 1 to 10 carbon atoms, a is a natural number, b and c are independently 0 or integers selected from 1–10, and d is 0 or an integer selected from 1–200.

2. The electrorheological fluid composition as set forth in claim 1, wherein said carbon black shows a pH below 6.

3. An electrorheological fluid composition comprising dielectric particles as a disperse-phase and an electrically insulating oil as a dispersion medium, the dielectric particle having a polymer portion and an electrically conductive carbon black portion;

wherein (i) said carbon black has a pH of below 6; and (ii) said polymer portion has a carbon—carbon bond in a main chain, and includes a silicone containing component and is grafted to said carbon black by an addition reaction; and wherein said silicone containing component has a polysiloxane containing structure unit represent by the formula:

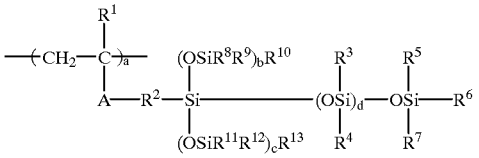

wherein A is —COO—, $R^1$ is hydrogen atom or methyl group, $R^2$ is an alkylene group having from 1 to 6 carbon atoms, $R^3$–$R^{13}$ are independently an aryl group, an alkyl group having from 1 to 6 carbon atoms or an alkoxy group having from 1 to 10 carbon atoms, a is a natural number, b and c are independently 0 or integers selected from 1–10, and d is 0 or an integer selected from 1–200.

4. The electrorheological fluid composition as set forth in claim 1 or 3 wherein said electrically insulating oil is a silicone containing insulating oil.

5. The electrorheological fluid composition as set forth in claim 1 or 3, wherein a carbon content in said carbon black portion is equal to or above 85% by weight.

6. The electrorheological fluid composition as set forth in claim 1 or 3, wherein said carbon black has a carboxyl group.

7. The electrorheolosical fluid composition as set forth in claim 1 or 3, wherein the ratio of the dielectric particles to the electrically insulating oil is 100 parts by weight to 100–2000 parts by weight.

8. The electrorheolotical fluid composition as set forth in claim 1 or 3, wherein said silicone containing component is in a side chain of the polymer portion.

* * * * *

UNITED STATES PATENT AND TRADEMARK OFFICE

CERTIFICATE OF CORRECTION

PATENT NO. : 6,096,235

DATED : August 1, 2000

INVENTOR(S) : Yoshinobu ASAKO et al.

It is certified that error appears in the above-indentified patent and that said Letters Patent is hereby corrected as shown below:

Column 26, line 55, "$R^{3-R13}$"

should read -- $R^3$-$R^{13}$ --

Signed and Sealed this

Tenth Day of April, 2001

*Attest:*

Nicholas P. Godici

NICHOLAS P. GODICI

*Attesting Officer*

*Acting Director of the United States Patent and Trademark Office*